United States Patent [19]

Juan

[11] 4,151,675

[45] May 1, 1979

[54] DOLLS THAT SIMULATE PHYSIOLOGICAL FUNCTIONS

[75] Inventor: Isidro R. Juan, Onil, Spain

[73] Assignee: Fabricas Agrupadas de Munecas de Onil, S.A., Alicanta, Spain

[21] Appl. No.: 832,000

[22] Filed: Sep. 9, 1977

[30] Foreign Application Priority Data

Nov. 12, 1976 [ES] Spain ..... 453279
May 30, 1977 [ES] Spain ..... 459304

[51] Int. Cl.[2] ..... A63H 13/02
[52] U.S. Cl. ..... 46/141; 46/7
[58] Field of Search ..... 46/116, 135 R, 135 A, 46/164, 171, 141, 7, 6, 8

[56] References Cited

U.S. PATENT DOCUMENTS

| | | | |
|---|---|---|---|
| 489,014 | 1/1893 | King | 46/135 R |
| 1,141,721 | 6/1915 | Mastin | 46/7 UX |
| 1,143,458 | 6/1915 | Stern | 46/141 |
| 2,675,644 | 4/1954 | Senior et al. | 46/141 X |
| 2,711,612 | 6/1955 | Wister | 46/7 |
| 2,907,139 | 10/1959 | Rekettye | 46/141 X |

FOREIGN PATENT DOCUMENTS

| | | | |
|---|---|---|---|
| 68614 | 4/1941 | Czechoslovakia | 46/141 |
| 1055173 | 2/1954 | France | 46/141 |
| 578606 | 7/1946 | United Kingdom | 46/141 |

*Primary Examiner*—Russell R. Kinsey
*Assistant Examiner*—Mickey Yu

[57] ABSTRACT

This invention relates to improvements in the manufacture of devices applicable to dolls that simulate physiological functions. On exerting pressure on a tank of water situated in the interior of the doll, a tube which commences in the interior of the tank below the level of the water, conducts a small flow of the said water towards the interior of the mouth of the doll and surrounding areas, although in a position in the mouth in front of a second tube which commences in the interior of the tank and in the area not occupied by water, with the purpose that the same pressure should originate a current of air which, on emerging adjacent to the first tube and also in the interior of the mouth, causes the creation of small bubbles and the outlet of small amounts of water that simulate the dribbling of the doll and because a third tube for filling the tank also commences in the interior of the mouth of the doll so that on placing a bottle of water into the mouth the filling of the tank is produced. A regulating valve is provided in the third tube so that the surplus quantity may be evacuated through this third tube up to a place appropriately situated in the anatomy of the doll, thus simulating the physiological function of urination.

4 Claims, 2 Drawing Figures

DOLLS THAT SIMULATE PHYSIOLOGICAL FUNCTIONS

This invention, as expressed in the description, refers to improvements in the manufacture of device applicable to dolls that simulate physiological functions, in such a way that the said improvements have been conceived in order to obtain dolls that simulate the intention of crying, as well as that of performing the physiological function of urination.

At the present time the various types and ranges of dolls that perform innumerable functions (crying, talking, laughing, walking, etc.) are very widely diffused, so that it is very simple to find on the market a doll that performs the function the customer desires. However, a doll that performs the function of a dissimulation of beginning to cry, or what is the same, a doll that performs the typical function of pouting preparatory to crying, as well as performing the physiological function simulating urination does not exist at the present time, so that the present invention has been conceived in regard to obtaining a system or a means capable of effecting the above-mentioned functions.

Consequently, the purpose of this invention consists in the fact that the doll is capable of simulating the dribbling of a child and the physiological function of urinating; for which purpose the doll is provided with a flexible water tank from which a tube emerges which connects the above-mentioned water tank with the doll's mouth, in such a way that the said tube commences below the level of the water contained in the tank, that is to say it reaches practically to the bottom of the said tank. In turn, the said tank is also connected with the mouth by means of a second tube that commences above the maximum level of the water, at the same time that its connection with the mouth is effected behind the previous or first-mentioned tube.

Furthermore, and independently, the mouth is connected with a third tube, larger in diameter than the previously-mentioned tubes, which is connected to the water tank by means of a valve which regulates the passage of the water, thus on introducing a bottle of water into the doll's mouth, the water passes through the said third tube and part of it goes to the tank, while the rest continues in an extension of the above-mentioned third tube, since the valve causes the surplus water that does not go into the tank to be evacuated through the said extension of the third tube to a place appropriately situated in the anatomy of the doll.

Moreover, it should be stated that the water tank may be situated in the interior of the doll's body or it may be constituted by one of the doll's extremities such as arms or legs.

In order to complete the description that will be given below, and with the purpose of aiding a better understanding of the characteristics of the invention, a single sheet of drawings is attached to this descriptive memorandum in which there is represented a schematic view, by way of an orientational and not a limitative example, of the arrangement of the elements or parts that constitute the improvements in the manufacture of the device applicable to dolls, made in accordance with the invention.

DESCRIPTION OF THE DRAWINGS

Figure 1:
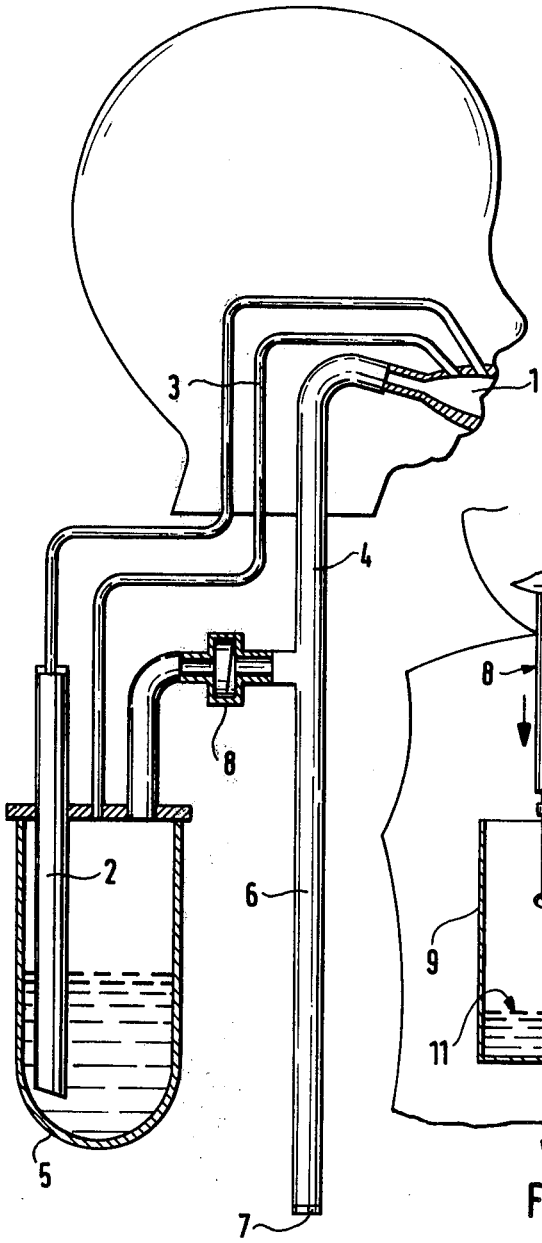
FIG. 1 is a perspective view of the instant invention.
Figure 2:
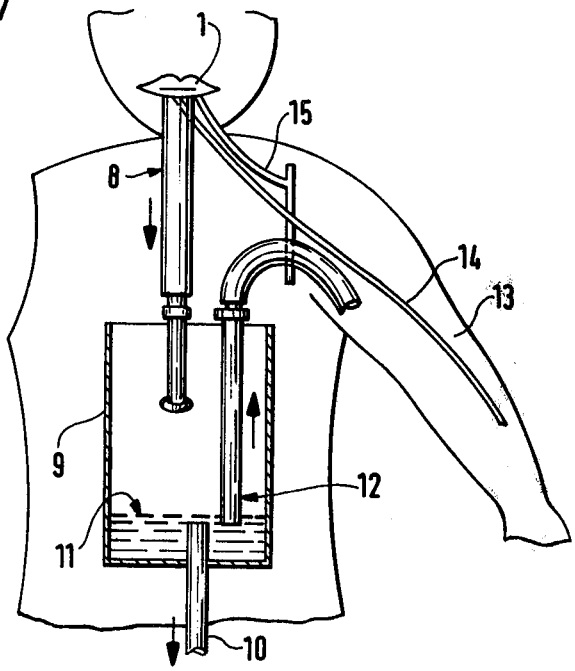
FIG. 2 is an alternative embodiment of the instant invention.

On examining the above-mentioned drawings the mouth (1) of the doll may be seen, which is connectd to a water tank (5) by means of two tubes (2) and (3) in such a way that the first tube (2) commences in an area close to the bottom of the tank (5), that is to say below the level of the water; while the second tube (3) commences in the upper part of the tank (5) or, what is the same, above the level of the water, the said second tube (3) opening out into the mouth (1) behind the above-mentioned first tube (2).

In this way, on exerting pressure on the corresponding area of the doll where the tank (5) is situated, a flow of water is caused through the first tube (2) from the tank (5) to the mouth (1). In turn, a flow of air is caused, also to the mouth, so that the mixture of air which flows out through the said tube (3) and of water that flows out through the first tube (2) will cause a number of little bubbles, and the outflow of small quantities of water that simulate the dribbling of the doll, characteristic of the intention to cry, or the pouting of a child about to cry.

Furthermore, the mouth (1) is also connected with the tank (5) by means of a third tube (4) larger in diameter than the others, in such a way that on introducing a bottle of water into the mouth (1), and exerting slight pressure, the water passes through the said third tube (4) to the tank (5), thus producing the filling of the said tank. However, the tube (4) is equipped with a regulating valve (8) so that surplus quantity of water is evacuated through an extension of the same tube (4), the said evacuation being effected through its lower free end (7) up to an appropriately situated place in the anatomy of the doll, thus simulating the physiological function or urination.

This invention is improved by means of a tank from which a suction tube originates, which is connected with one of the doll's arms constituted into a flexible tank and connected with the mouth by means of the tubes for the impulsion of water and air, in accordance with the preceding solution, so that on exerting pressure on the arm the meeting of water and air is caused to take place in the mouth thus simulating little bubbles. At the moment of releasing the arm and on its expanding, the suction of water from the storage tank is produced, which water is deposited in the flexible tank constituted by the arm, preparing for a new cycle.

That is to say that the functions provided for in the preceding variant are maintained, although they are produced in a different way on including a storage tank, generally not flexible, in such a way that the water poured into its interior has to cover the level provided for the mouth of the tube that discharges towards the urination function so that it may be expelled, while in accordance with the preceding solution, the water emerges without the possibility of regulation during the process of filling the tank by means of the bottle.

The formation of bubbles in the mouth in the form of dribbling is obtained in the same way as in the first solution, although the water is supplied from the storage tank by means of the take-up by absorption of the water that is stored in the arm in order to be pumped to the mouth together with the air.

In accordance with the invention, and in accordance with FIG. (2) of the drawings, in the interior of the doll's body a water storage tank (9) is situated, generally of a non-flexible nature, the said tank (9) is connected with the mouth (1) by means of a tube (8) for the intake of water, in such a way that on introducing a bottle of water into the doll's mouth the water is discharged into the tank (9) up to a certain level (11) determined by the mouth of an outlet tube (10) situated at a certain level above the bottom of the tank (9) so that the water poured into the tank covers the pre-established level (11) and the rest is caused to flow through the outlet tube (10) towards a point of evacuation to the exterior, simulating the function of urination.

The said tank (9) is connected to one of the arms (13) or to any other point in which a flexible tank is provided which acts in the form of an impelling suction pump, connected to the mouth (1) by means of two tubes, one (14) for impulsion of water and the other (15) for the impulsion of air, which act in accordance with the arrangement of the first embodiment.

In this way, by means of an effective pressure being exerted on the arm (13), the water contained in its interior is conducted or impelled through the tube (14) to the mouth at the same time that the depression causes an escape of air through the tube (15) also towards the mouth, producing the mixture of both fluids in order to produce the bubbles that simulate dribbling; on ceasing to exert pressure on the arm, its expansion determines the suction of water from the tank (9) through the tube (12) in order to permit initiating another cycle, giving a suction-impulsion continuity by successive pressures and expansions of the arm which determines the simulation of the pouting of a child about to cry.

What is claimed is:

1. A device for use in dolls that simulate physiological functions, said device comprising:

a tank situated in the interior of the doll for containing water;

a first tube extending from a point in said tank below a normal water level to the interior of the mouth of the doll for conduction a small flow of the water from said tank to the interior of the mouth and surrounding areas upon the exerting of pressure on said tank;

a second tube extending from a point in said tank above the normal water level to a point in the interior of the mouth of the doll behind said first tube, the exerting of pressure on said tank causing a flow of air through said second tube to the mouth of the doll, said flow of air emerging in the mouth of the doll adjacent said first tube, whereby small bubbles are formed and small amounts of water are discharged from the mouth of the doll to simulated the dribbling of a baby;

a third tube extending from the mouth of said doll to said tank for filling said tank from a bottle of water placed into the mouth of the doll; and a regulating valve in said third tube for controlling the flow of water into said tank by directing a surplus of water to an appropriately situated point for simulating urination.

2. The device as claimed in claim 1, wherein said tank is formed in one of the extremities of the doll.

3. The device as claimed in claim 1, further comprising a second tank communicating with the first-mentioned tank, said second tank functioning as a water storage tank, said first-mentioned tank functioning as a suction-explusion pump and drawing water from said second tank when said first-mentioned tank expands.

4. The device as claimed in claim 1, wherein said regulating valve includes a fourth tube extending from said normal water level in said tank to said appropriately situated point, whereby said fourth tube acts as an overflow for conducting the surplus water to said appropriately situated point.

* * * * *